US007494075B2

(12) United States Patent
Schneider

(10) Patent No.: US 7,494,075 B2
(45) Date of Patent: Feb. 24, 2009

(54) PRESSURE CONTROL VALVE

(75) Inventor: Heinz Schneider, Langenselbold (DE)

(73) Assignee: Thomas GmbH, Langenselbold (DE)

( * ) Notice: Subject to any disclaimer, the term of this patent is extended or adjusted under 35 U.S.C. 154(b) by 218 days.

(21) Appl. No.: 10/516,458

(22) PCT Filed: Jun. 30, 2003

(86) PCT No.: PCT/EP03/06917

§ 371 (c)(1),
(2), (4) Date: Dec. 17, 2004

(87) PCT Pub. No.: WO2004/002853

PCT Pub. Date: Jan. 8, 2004

(65) Prior Publication Data

US 2005/0205133 A1 Sep. 22, 2005

(30) Foreign Application Priority Data

Jun. 28, 2002 (DE) ..... 102 29 185

(51) Int. Cl.
*B05B 1/30* (2006.01)

(52) U.S. Cl. ..... 239/571; 239/573; 239/337; 239/350; 239/436; 239/391; 239/394; 251/348; 251/353; 222/402.1; 222/402.22; 222/402.15; 222/402.25; 222/402.2; 222/153.12; 137/630.22

(58) Field of Classification Search ..... 239/573, 239/579, 337, 436, 397, 394, 353, 391, 350, 239/354, 372, 571; 251/348, 353, 354, 349; 222/402.22, 402.12, 402.15, 402.1, 402.13, 222/402.25, 402.24, 402.23, 402.2, 476, 222/402, 453, 153.12; 137/628, 630.22, 137/114

See application file for complete search history.

(56) References Cited

U.S. PATENT DOCUMENTS

| | | | | | |
|---|---|---|---|---|---|
| 3,294,118 | A | * | 12/1966 | Wieden et al. | 137/588 |
| 3,378,205 | A | * | 4/1968 | Barker | 239/337 |
| 3,666,148 | A | * | 5/1972 | Webster | 222/396 |
| 4,413,755 | A | * | 11/1983 | Brunet | 222/402.2 |
| 5,011,047 | A | | 4/1991 | Cruysberghs | |

(Continued)

FOREIGN PATENT DOCUMENTS

WO WO0196208 A1 * 12/2001

*Primary Examiner*—Len Tran
*Assistant Examiner*—Trevor E. McGraw
(74) *Attorney, Agent, or Firm*—Stites & Harbison PLLC; Douglas E. Jackson

(57) ABSTRACT

A pressure regulating valve reduces the increased internal pressure in an aerosol spray can, filled with compressed gas, to a working pressure level for a spray valve (12). A regulating piston (52) is kept in equilibrium by a restoring force, and a sealing point (66, 68) is provided, which is closed at a pressure in the pressure regulation chamber (84) that is above the regulated pressure level. To prevent the precision of regulation from being adulterated by the decreasing internal pressure of the can as its contents are progressively withdrawn, a sealing means (86, 66; 67) is proposed, which seals off one free end of the piston (52, 74) from the internal pressure of the can and the regulated pressure. The variable internal pressure of the can is therefore no longer able to act on any axial face of the piston (52), and despite what may be a smaller piston face area, the precision of regulation is improved.

23 Claims, 8 Drawing Sheets

Figure 1:
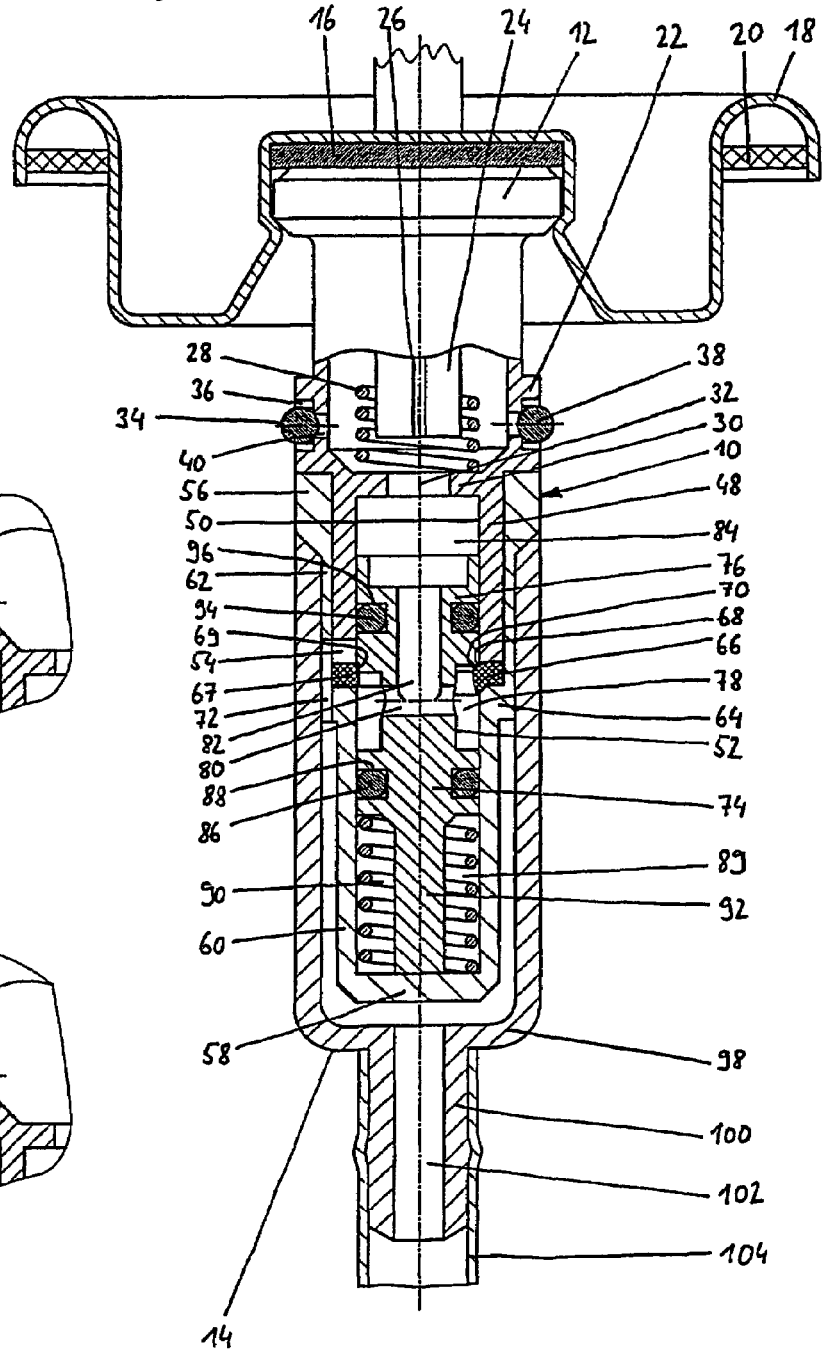

U.S. PATENT DOCUMENTS 5,119,970 A * 6/1992 Arieh et al. ..... 222/1
6,039,306 A * 3/2000 Pericard et al. ..... 251/353
6,145,712 A * 11/2000 Benoist ..... 222/402.1
6,394,364 B1 * 5/2002 Abplanalp ..... 239/354
6,802,461 B2 * 10/2004 Schneider ..... 239/337
6,880,733 B2 * 4/2005 Park ..... 222/397

* cited by examiner

PRESSURE CONTROL VALVE

The present invention relates to a pressure regulating valve for use in an aerosol spray can having a spray valve, in which the pressure regulating valve lowers a pressure level, prevailing in the compressed-gas-filled interior of the can, to a regulation pressure level at which the spray valve operates, and the pressure regulating valve has a regulating piston, which is guided in a housing and is kept in equilibrium between a pressure, acting on the piston face in a pressure regulation chamber and a restoring force, and between the regulating piston and the housing, a sealing point is provided, which is closed at a pressure in the pressure regulation chamber above the regulation pressure level.

Such pressure regulating valves are needed in aerosol spray cans that operate without a propellant gas, that is, chemical aerosol propellants; the avoidance of such propellant gases makes it necessary to fill the aerosol can to a markedly higher pressure, such as 10 bar. Since the spray valves operate at a defined lower pressure level, as is also the case in aerosol spray cans used until now with a propellant gas filling, and emptying of the rest of the can should be as complete as possible, it is necessary to use a pressure regulating valve that precedes the spray valve and that lowers the internal pressure of the can to the pressure suitable for the spray valve, which for instance is 3 bar. Pressure regulating valves of the type defined at the outset are described for instance in International Patent Disclosure WO 01/09009 A1, European Patent Disclosure EP 0 931 734 A1, and International Patent Disclosure WO 01/96208 A1. All the pressure reducing valves described in these references have the disadvantage that the initially very high internal pressure of the can acts on an axial face of the piston element, and even in those cases in which only the comparatively small shaft end of the piston is acted upon by the high pressure, still there is a not inconsiderable axial force on the piston element. If the internal pressure of the can were to remain constant, this disturbing force could easily be corrected. However, since with increasing evacuation of the contents the internal pressure of the can decreases continuously, the magnitude of the disturbing force also varies, so that the disturbance variable can no longer be readily compensated for. In the final analysis, the effect is that the regulated pressure of the pressure regulating valve varies as a function of the still-remaining fill pressure in the aerosol spray can, which is unwanted since as a result the spray valve can no longer function optimally. Some compensation can indeed be provided by selecting the piston face to be as large as possible in the region of the pressure regulation chamber, so that the axial end face of the piston shaft, for instance, is less important as a disturbance variable; however, this requires a considerable increase in the structural volume of the pressure reducing valve, which means that the maximum possible can contents are reduced. The smaller the piston face in the pressure regulation chamber is selected to be, the greater is the deviation in the regulated pressure between the initial state and the nearly completely evacuated state.

The object of the present invention is to improve a pressure regulating valve of the type defined at the outset such that with the smallest possible structural volume, greater precision of regulation, at a varying internal pressure of the can, is attainable.

According to the invention, this object is attained in that a sealing means is provided, which seals off a free end of the piston, remote from the pressure regulation chamber, from the internal pressure of the can and the regulated pressure, so that the pressures acting on axial faces on the free end of the piston are independent of the level of the internal pressure of the can.

By shielding off the free end of the regulating piston, which so far has been exposed to the internal pressure of the can, the disturbing force that varies as a function of the degree of filling and thus the internal pressure of the can is eliminated, so that the regulated pressure of the pressure regulating valve no longer depends on the internal pressure of the can existing at that moment. Moreover, the piston diameter can be kept small, since because of the shielded-off free end, the precision of the valve no longer depends on the size of the piston face in the pressure regulation chamber; instead, a smaller face area and a restoring force correspondingly adapted to it can be used, the latter being generated for instance by a spring or a gas pressure cushion. As a result, the installation space required for the pressure regulating valve is decreased, and thus more room for the can contents is available.

In a preferred embodiment of the invention, it is provided that the sealing point is provided in a middle region of the regulating piston, which at that point preferably has an annular groove. In this way, simple shielding of the free end can be attained, for instance with the aid of a sealing ring as the first seal, which closes the gap between the piston and the housing surrounding it. On the other hand, in this arrangement, the sealing point can be embodied simply with the aid of an O-ring- or annular disk-like sealing element protruding for instance radially into the annular groove. The connection between the sealing point and the pressure regulation chamber is preferably affected via openings in the piston, for instance by a transverse bore originating at the sealing point and an axial bore that connects the transverse bore to the pressure regulation chamber.

In a preferred refinement of the invention, it is provided that the piston shaft is sealed off from the cylindrical housing on both sides of the sealing point, and on one side of the sealing point, a first seal is provided as part of the sealing means on the free end. The disposition of the sealing point in the middle region of the regulating piston offers the advantage that simple sealing off of the gap between the piston and the housing from the internal pressure of the can on both sides is possible. A seal assures that the pressure regulation chamber is sealed off from the internal pressure of the can, while the first seal assures the sealing off of a closed chamber in which not only the free end of the piston but preferably also the restoring spring are disposed; the restoring spring can for instance be embodied as a helical spring or as a pressurized gas spring. With the aid of spacer sleeves or shims of different lengths, the prestressing force of the spring can easily be adjusted, with no change in the pressure regulating valve otherwise.

Preferably, it is also provided that the piston diameter, viewed from the sealing point, is embodied differently in the two axial directions. This creates the possibility, in a further preferred embodiment of the invention, of embodying the sealing point with the aforementioned O-ring- or annular disk-like sealing element; the sealing element is fixed to the piston or the housing and cooperates sealingly with a shoulder, which may be formed as a result of the difference in diameter, on the housing or the piston, when the pressure in the pressure regulation chamber exceeds the regulated pressure level. The diameters of the piston and housing are understood to be embodied so as to fit one another in the applicable portions.

In still another preferred embodiment, it is provided that the cylindrical housing has two parts of the same or different inside diameters, adapted to the piston diameters; between the two parts, the sealing element is fixed, preferably with an annular ridge or protrusion, to attain a linear sealing point relative to at least one part. In this variant, the sealing element is clamped securely and in pressuretight fashion between the two housing parts.

The sealing off of the movable piston from the housing is preferably effected with the aid of O-rings, which are disposed in grooves in the housing or the piston. In a further preferred feature, it is provided that the grooves are embodied as wider than the respective O-ring, and in an especially preferred feature, the width of the grooves is selected such that the O-ring, in the adjusting range of the piston, rolls essentially without friction on the bottom of the groove and the opposite sealing face of the outsides of the piston and insides of the cylinder. Compared with a sliding ring seal, this kind of embodiment has the advantage that the forces of friction upon adjustment of the piston are substantially less, so that the mobility of the piston required for pressure regulation is attained with lesser frictional forces, and in turn the outcome of regulation is positively affected thereby.

In a further preferred embodiment of the invention, the housing part, for receiving the free end of the piston, is surrounded by a cuplike housing part, which forms one part of the connection of the can interior to the sealing point. This embodiment can be manufactured especially inexpensively because of the substantially rotationally symmetrical housing parts, while it is in principle also conceivable for the sealing point to be connected to the can interior by a neck integrally formed onto or attached to the housing.

The provision of a throttle restriction between the pressure regulation chamber and the spray valve can also be advantageous. As a result, the regulated pressure between the chamber and the spray valve can be reduced further.

The pressure regulating valve described above may be embodied as a separate unit and may have a neck, an insertion sleeve or the like, for instance, with the aid of which it can be connected to a neck of a spray valve either directly or via a tubular or hoselike piece. Such an embodiment makes it possible to retrofit a conventional aerosol spray can by simply connecting the pressure regulating valve upstream of the neck of the spray valve that is provided anyway, typically for attaching a riser tube; possibly only the body of the can has to be adapted to the increased pressure conditions. However, the subject of the invention equally includes an aerosol spray can have a spray valve and a pressure reducing valve preceding it, in one of the versions described above, as well as a valve unit for building into an aerosol spray can, which unit is embodied of a spray valve and a pressure reducing valve of the type described above, as a preassembled unit.

A further novel feature, which may also be employed in other pressure regulating valves, provides that on the outlet end of the pressure regulating valve toward the spray valve, an overpressure filling valve is provided, which above a predetermined limit pressure in the chamber between the spray valve and the pressure reducing valve opens a cross section for filling the aerosol can. Since at least a considerable proportion of the filling of the can is meant to be performed by the valves, to shorten the filling process, using such an overpressure filling valve is appropriate since most pressure regulating valves, when subjected to pressure from outside, do not open any cross section, or individual sealing elements are overstressed.

Figure 2:
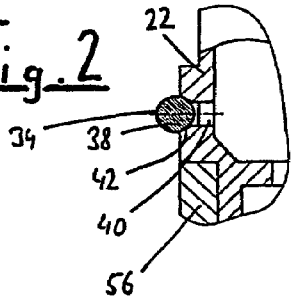
Figure 3:
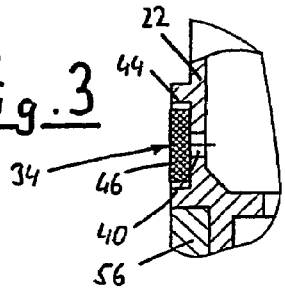
Figure 4:
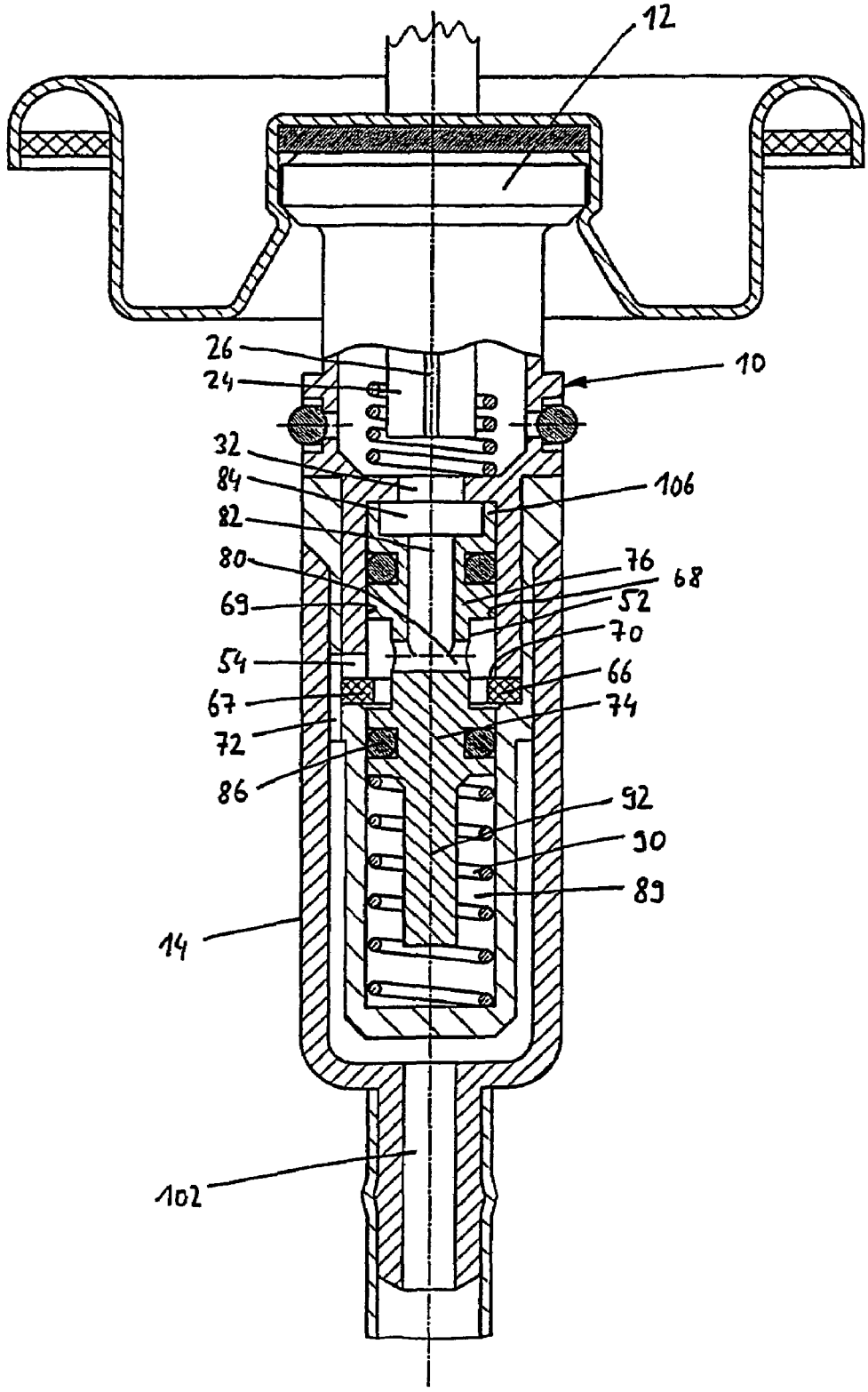
Figure 5:
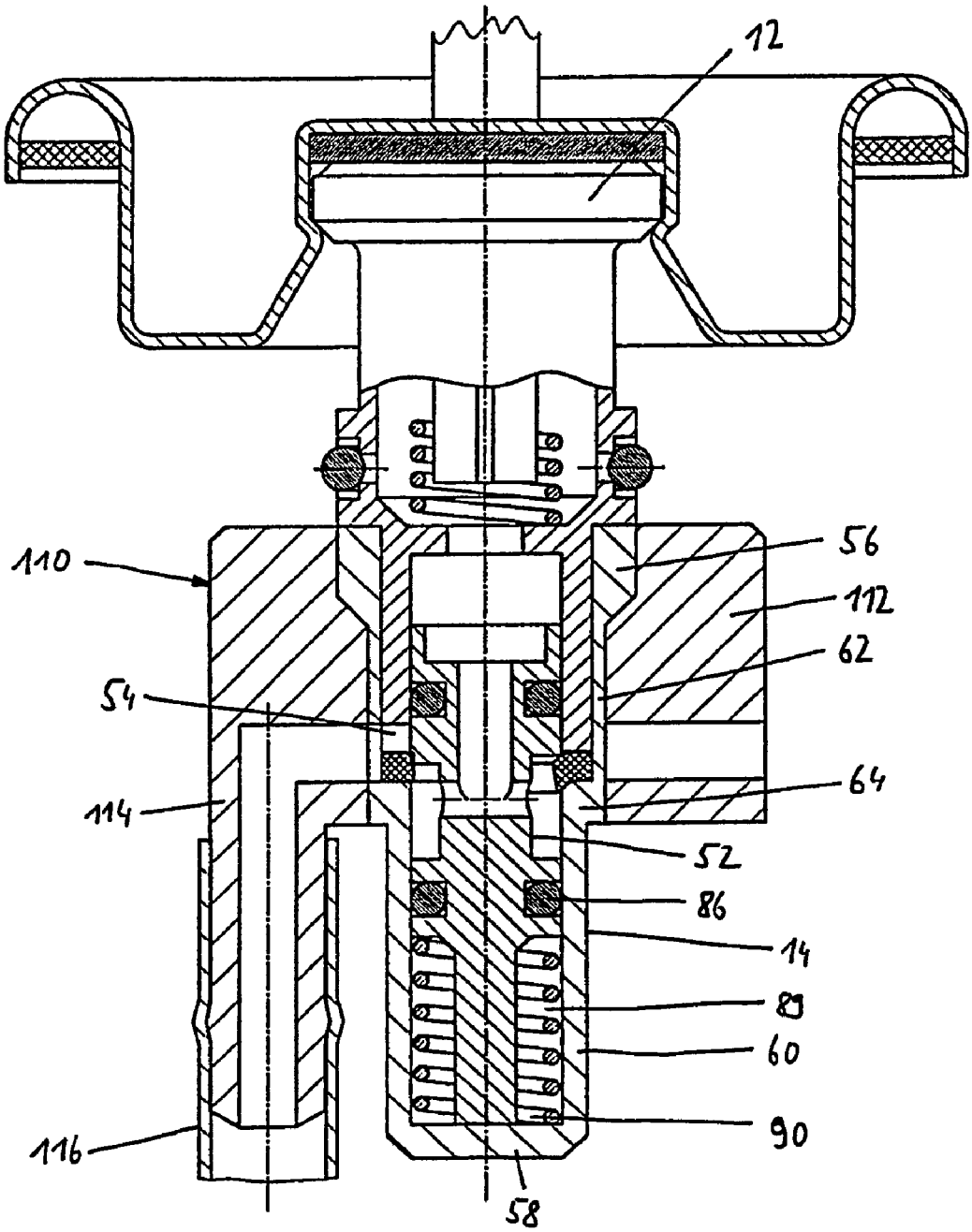
Figure 6:
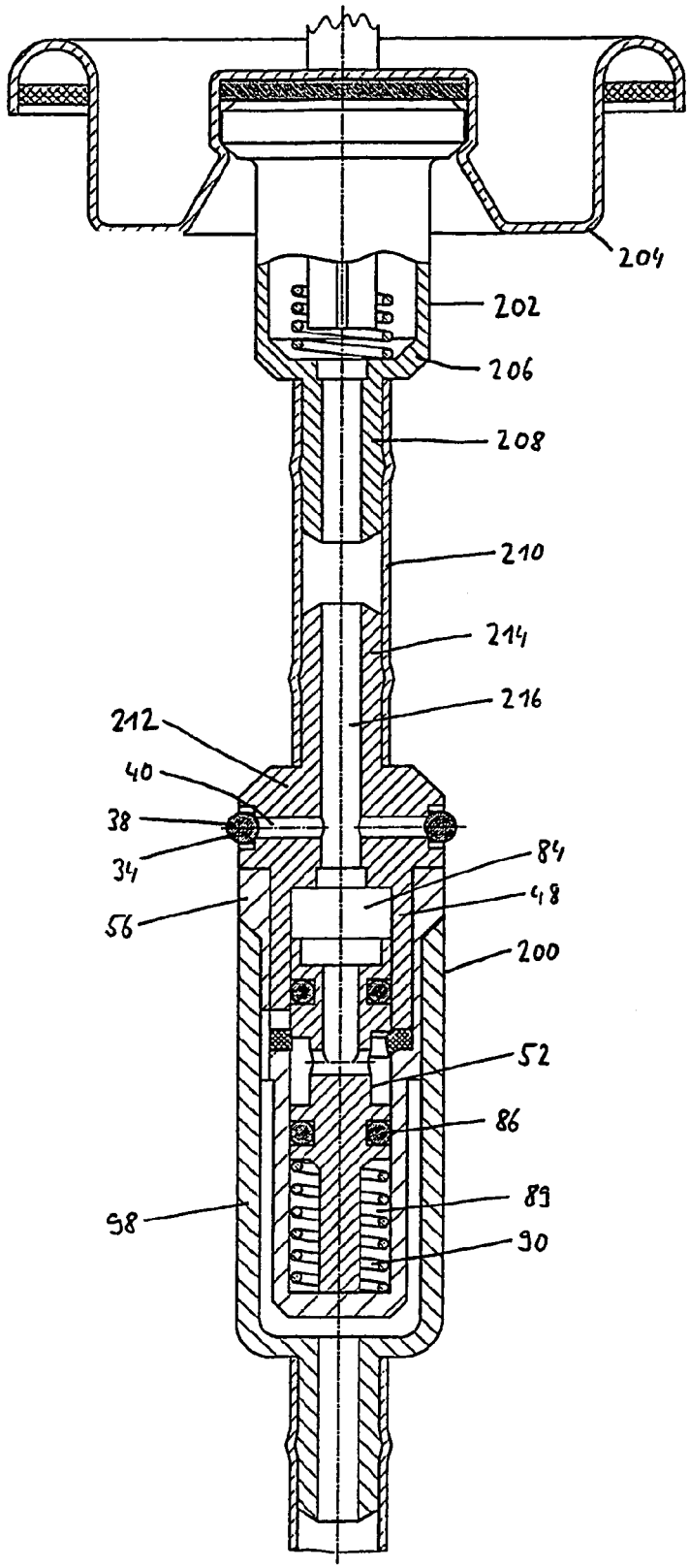
Figure 7:
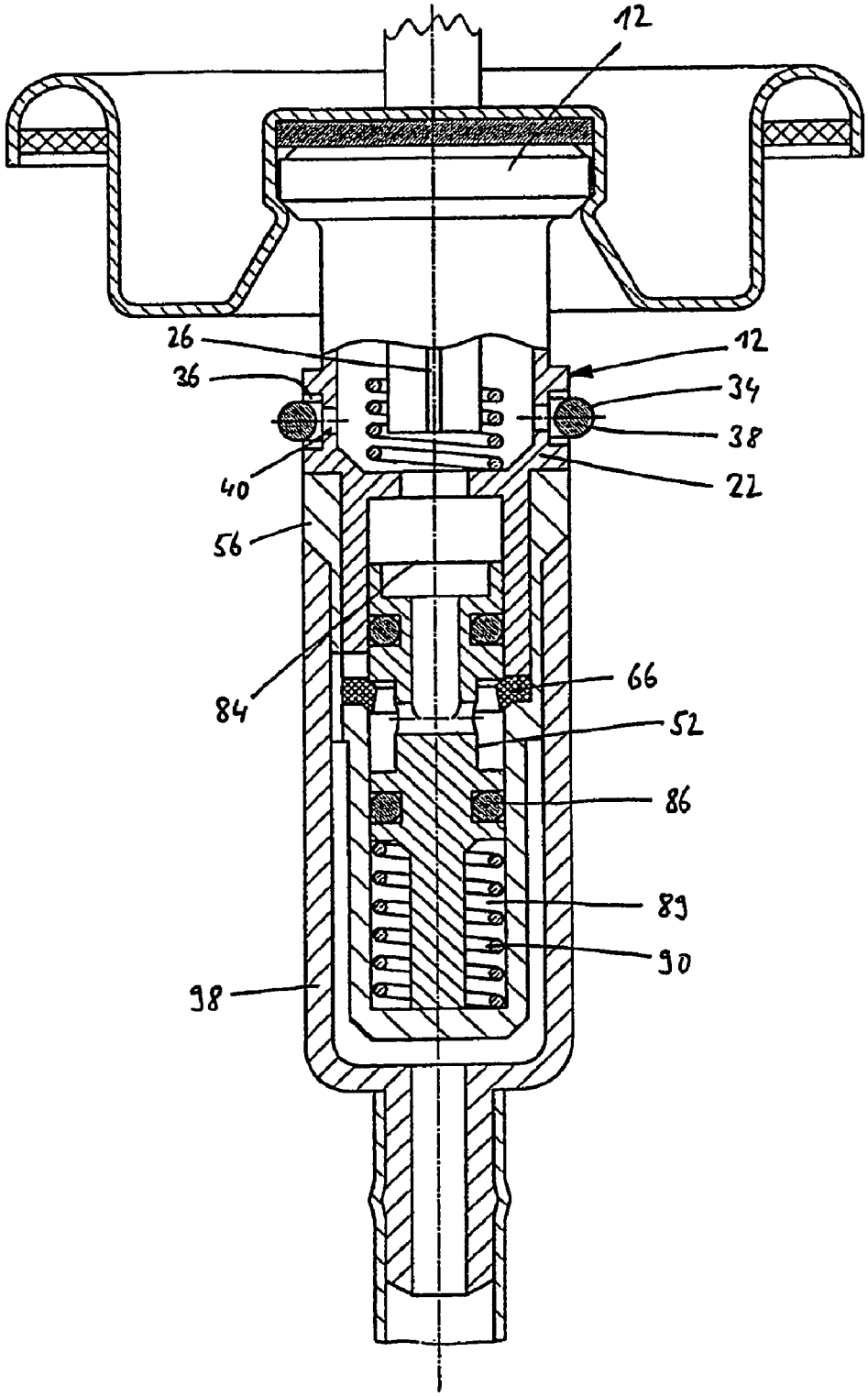
Figure 8:
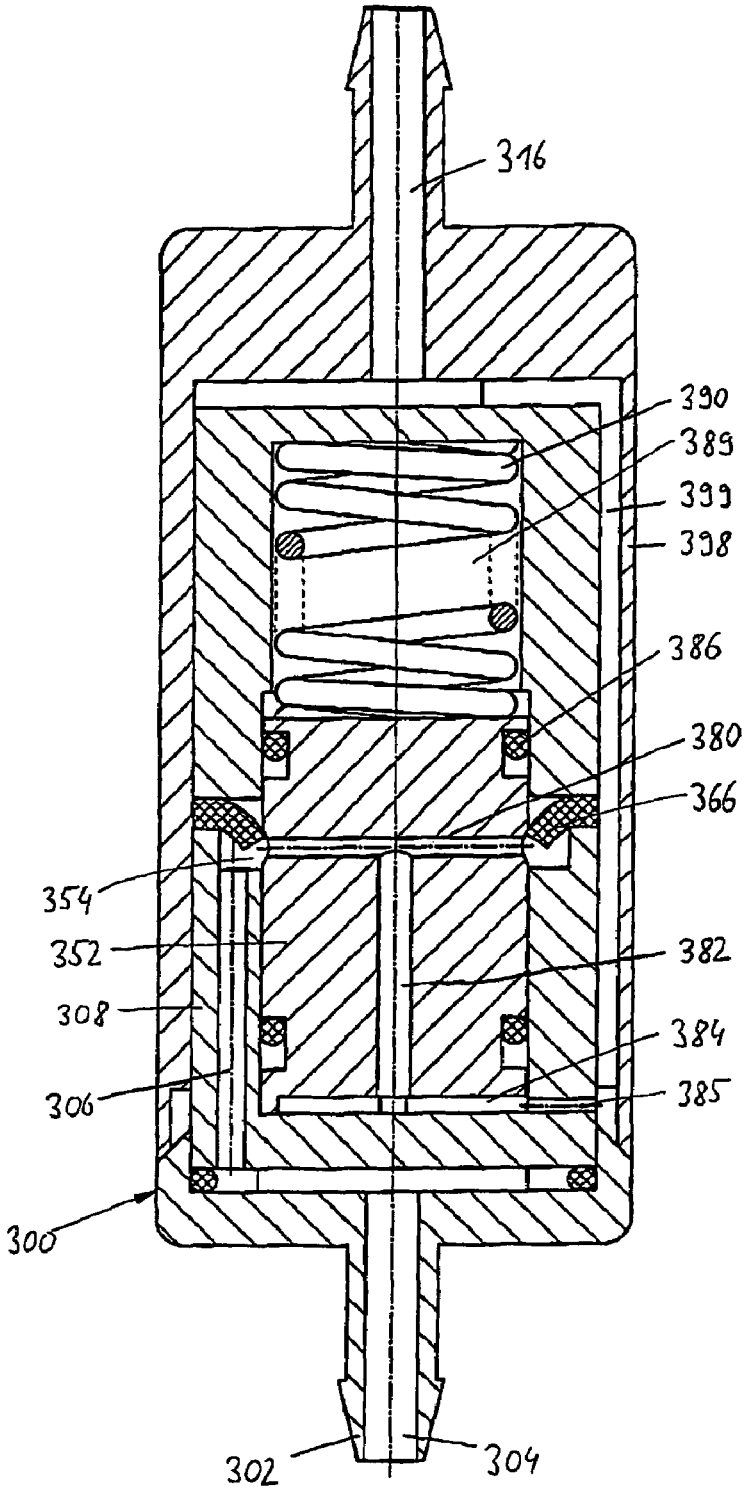
Figure 9:
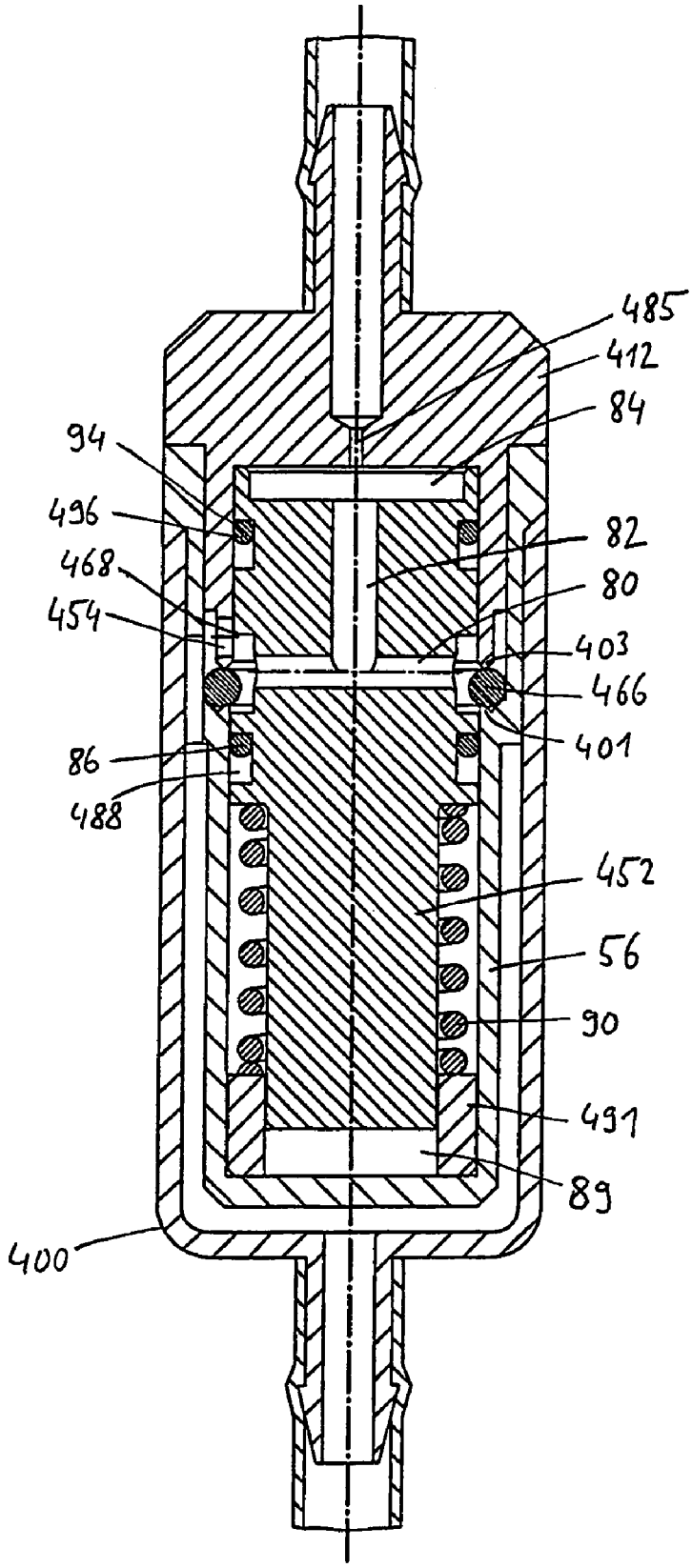
Figure 10:
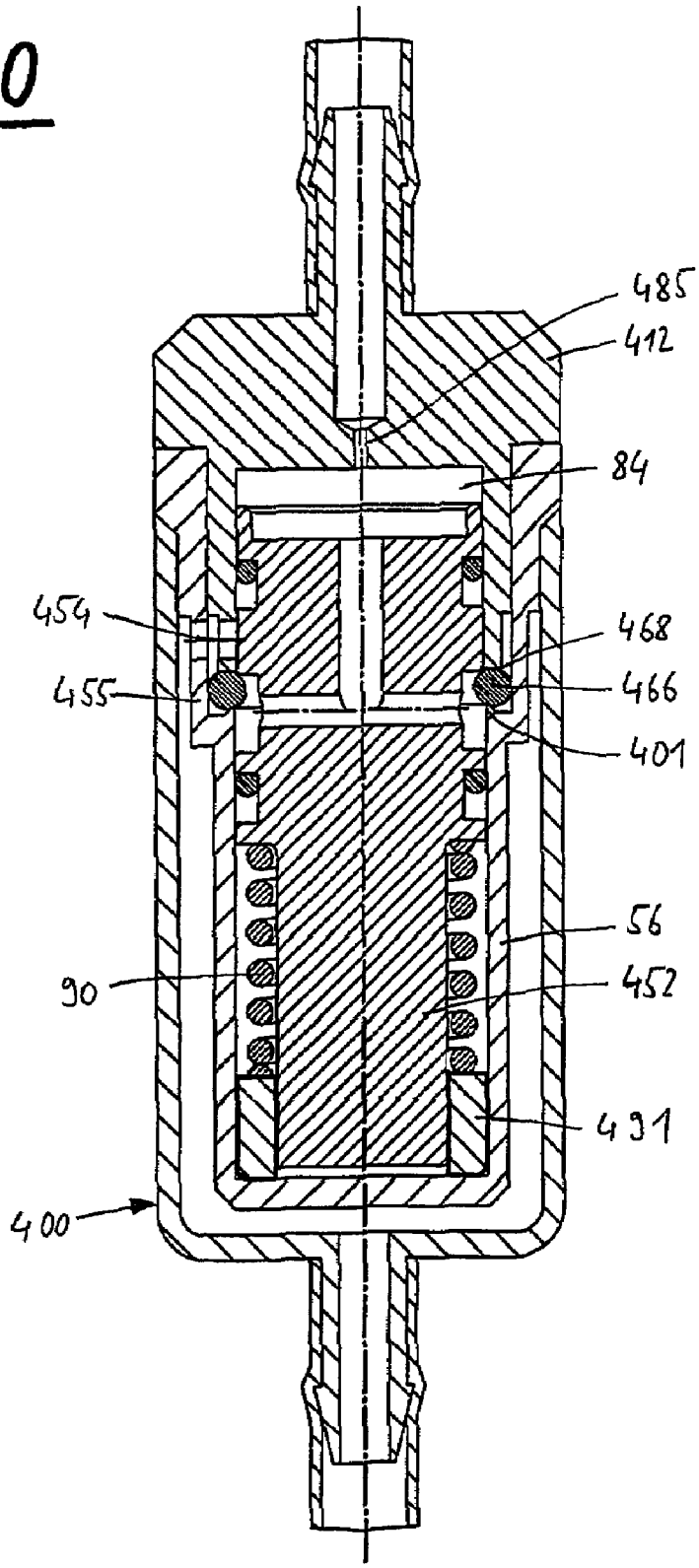

Below, in conjunction with the drawings, exemplary embodiments of the invention will be described in further detail. Shown are:

FIG. 1, a longitudinal section through a combined unit comprising a spray valve and a pressure regulating valve for an aerosol spray can;

FIG. 2, a detail of an alternative version of a valve of the unit of FIG. 1 for overpressure filling;

FIG. 3, a detail of a further version of the valve for overpressure filling;

FIG. 4, a longitudinal section through the unit of FIG. 1, with the valve cross section of the pressure regulating valve open;

FIG. 5, a longitudinal section through a further version of a unit comprising a spray valve and a pressure regulating valve;

FIG. 6, a longitudinal section through a region of the valve of an aerosol spray can, with the spray valve and pressure regulating valve embodied separately;

FIG. 7, a longitudinal section through the unit of FIG. 1 with the overpressure filling valve open;

FIG. 8, a longitudinal section through a further version of a pressure regulating valve;

FIG. 9, a longitudinal section through still another version of a pressure regulating valve in the open position;

FIG. 10, a longitudinal section through a pressure regulating valve in the closed state, which is essentially equivalent to the pressure regulating valve of FIG. 9.

In FIG. 1, a combined unit 10 comprising a spray valve 12 and a pressure regulating valve 14 is shown. In its internal construction, the spray valve 12 is equivalent to conventional spray valves and is therefore not shown in further detail. The unit, with the spray valve 12, is preassembled on a valve plate 18 and sealed off in a manner known per se by means of a sealing disk 16; the valve plate is then secured in sealed fashion to a can body (not shown), with the aid of a sealing ring 20.

The spray valve has a spray valve housing 22, in which a stem 24 with one end 26 and a through opening is displaceable counter to the load of a compression spring 28. The spray valve housing 22 has a partition 30 with a through opening 32, which separates the spray valve 12 from the pressure regulating valve 14. In the wall of the spray valve housing 22, an overpressure filling valve 34 is provided, which essentially comprises an annular sealing element 38, disposed in prestressed fashion in an annular groove 36 in the outer wall of the spray valve housing 22; at least one or more flow openings 40 disposed over the circumference are provided in the bottom of the annular groove 36. Upon filling of the aerosol can in the installed state, with the aid of an overpressure of 12 bar, for instance, which is exerted from outside with the spray valve 12 open, so that this overpressure prevails in the spray valve housing 22, the overpressure filling valve 34 has the function of making it possible to supply gas to the can interior directly, since at such a high pressure in the region of the spray valve housing 22, the pressure regulating valve 14 is closed. Via the flow openings 40, the high filling pressure acts on the annular sealing element 38 and because of the resultant pressure forces easily lifts it, so that the compressed gas can flow past the sealing element 38 into the can interior (see FIG. 7). After the filling process is ended, the exertion of pressure is terminated, and the annular sealing element 38 presses firmly against the flow openings 40, because of its intrinsic elasticity and in particular under the internal pressure of the can now acting on it, so that these openings are permanently closed, and the pressure in the spray valve housing 22 can drop to a desired pressure level.

As the overpressure filling valve, in principle any kind of valve may be used in this region, but the version shown, with an annular sealing element, can be realized especially simply. In FIGS. 2 and 3, further alternatives with an elastic, annular sealing element are shown. In FIG. 2, with the same annular sealing element 38 of circular cross section, an annular groove 42 is provided in the outer circumference of the spray valve housing; its flanks are embodied as converging obliquely, so that the result is a more two-dimensional contact of the sealing element 38 with the flanks of this groove 32. In turn, at least one flow opening 40 is provided, through which compressed gas can flow in the filling process. In FIG. 3, a version is shown in which once again an annular groove 44 is provided in the outer wall of the spray valve housing 22; similarly to the version shown in FIG. 1, this annular groove has a rectangular cross section, but it is embodied as wider, so that it can accommodate a sealing element 46 embodied with a rectangular cross section as an annular flat seal. The flow openings 40 correspond in number and embodiment to the version shown in FIG. 1.

On its face end, the spray valve housing 22, has an annular extension 48, extending from the partition 30, that forms part of a hollow cylinder 50 of the pressure regulating valve 14, in which cylinder a regulating piston 52 to be described in further detail hereinafter is movably guided. The annular extension 48, on its free end, has at least one transverse opening 54, through which the can contents can flow upon evacuation, which will also be addressed in further detail hereinafter.

A cup-shaped inner housing 56 is seated on the annular extension 48. Its cylindrical wall comprises a first cylindrical wall portion 60, which adjoins a bottom 58 and whose inside diameter is adapted to the diameter of the regulating piston 52; a second cylindrical wall portion 62, whose inside diameter is adapted to the outside diameter of the annular extension 48; and a shoulder 64, located between the two wall portions 60, 62. Between the shoulder 64 and the annular end face of the annular extension 48, an annular sealing element 66 or 67 is provided, which closes the annular extension in pressuretight fashion against the second cylindrical wall portion 62 and which protrudes into the cylinder 50; in cooperation with a sealing flank 68, 69 of the regulating piston 52, it defines the sealing point of the pressure regulating valve 14. In the left half of the drawing, a sealing element 67 is shown, which in the closing state, with slight elastic widening, cooperates sealingly with the annular outer face 69 of the piston 52, while in the right half of the drawing in FIG. 1, one corner 68 of the piston 52 cooperates sealingly with an axial end face 70 of the sealing element 66; in this case, the annular sealing element 66 protrudes somewhat farther radially inward into the cylindrical bore 50 than in the case of the annular sealing element 67. Furthermore, on its circumference, the cylindrical wall portion 62 has at least one recess 72, which in the installed state is aligned with an associated transverse opening 54. In the region of the second wall portion, the diameter of the cylindrical bore may be greater than in the region of the first wall portion; the outer diameters of the piston are then correspondingly graduated. In such a version, the sealing element in the closing position is clamped essentially axially between the housing and the shoulder of the piston, and as a result under some circumstances is mechanically less severely stressed.

The regulating piston is guided movably in the cylindrical bore 50 formed by the annular extension 48 and the first cylindrical wall portion 60 of the inner housing 56. The regulating piston 52 has a lower shaft portion 74, which is guided in the first cylindrical wall portion 60, and an upper shaft portion 76, which is guided in the annular extension 48. The two shaft portions 74, 76 are separated in the region of the sealing point by an annular groove 78 in the regulating piston 52; via at least one transverse opening 80 and a middle bore 82 in the upper shaft portion 76, the annular groove 78 is in communication with a pressure regulation chamber 84, which in turn communicates with the interior of the spray valve housing 22 via the through opening 32 in the partition 30.

A first seal 86 in the form of an O-ring is seated in a corresponding annular groove 88 in the lower shaft portion 74 and seals that portion off from the first cylindrical wall portion 60 of the inner housing 56. As a result, a chamber 89 that is closed off in pressuretight fashion is created between the lower shaft portion 74, the first cylindrical wall portion, and the bottom 58 of the inner housing 56; a restoring spring 90 is disposed in this chamber and exerts a defined restoring force on the piston 52. A piston extension 92, which adjoins the lower shaft portion 74, limits the stroke length of the regulating piston 52 by becoming seated on the bottom 58 of the inner housing 56. In this way, the annular sealing element 66 is prevented from being sheared off by the corner 68 of the upper shaft portion 76, for instance if a considerable overpressure, such as 12 bar, prevails in the pressure regulation chamber 84 when it is being filled with compressed gas.

A second seal 94 in the form of an O-ring is seated in an annular groove 96 in the upper shaft portion 56 of the piston and seals that portion off from the inner wall of the annular extension 48. Both annular grooves 88, 96 in the shaft portions 74, 76 may be embodied as wider than the sealing rings 86, 94 received in them, so that upon the motion of the piston, these rings execute a rolling motion, rather than a sliding motion, along the inner faces of the cylindrical bore 50. The rolling motion is considerably lower in friction and improves the precision of regulation by the pressure regulating valve 14.

A cup-like outer housing 98 is seated on the outer wall of the inner housing 56; it surrounds the inner housing 56 in the region of the cylindrical wall portion 60 and the bottom 58 with spacing, and the outer housing, in its bottom, has a neck 100 with a through bore 102, on which a riser tube 104 is mounted.

In the position of repose shown in FIG. 1, in the installed state, after the aerosol container has been filled with pressure, the sealing point is closed by the cooperation of the outer face 69 or the corner 68 of the upper shaft portion 76 of the piston with the respective annular sealing point 66 or 67 provided, and the spray valve 12 is also sealed off. This means that the filling pressure level of 10 bar, for instance, prevails in the can interior, in the riser tube 104, in the through bore 102, between the inner housing 56 and the outer housing 98, and in the recesses 72 and the transverse openings 54. Downstream of the sealing point, once the spray valve 12 has been actuated, the desired regulated pressure of 3 bar, for instance, prevails in the annular groove 78, the transverse opening 80, the middle bore 82, the pressure regulation chamber 84, and the interior of the spray valve housing 22; the restoring spring 90 in the chamber 89 is compressed, and in the exemplary embodiment shown, the piston extension 92 has become seated on the bottom 58, although this is not absolutely required. The regulated pressure acts in the pressure regulation chamber on the axial end face of the regulating piston 52, while in the middle region, the effect of the pressure on the opposed axial faces of the two shaft portions 74, 76 of the piston 52 is cancelled out.

If a withdrawal of the can contents is effected by actuation of the spray valve 12, the pressure drops, including in the pressure regulation chamber 84; that is, the axial forces acting counter to the restoring spring 90 on the piston 52 decrease. As a result, the restoring spring 90, optionally in cooperation with an overpressure existing in the chamber 89, is capable of moving the piston in the direction of the terminal position shown in FIG. 4, although the terminal position shown in FIG. 4, which is limited by an annular stop 106 on the upper shaft portion 76 by contact with the partition 30 is as a rule attained only if a very great amount has been withdrawn or if the pressure level in the can interior has already dropped very sharply. To avoid a large-area contact which could have an influence on the regulating performance, the annular stop may be provided with a chamfer, that is, a linear contact region, or with points or bumps, for point-type contact. In each case, the sealing face 68, 69 of the upper shaft portion 76 is lifted from the respective sealing element 66, 67, so that between the transverse openings 54 and the annular groove 78, a cross section opens up through which the can contents can reach the spray valve. After the closure of the spray valve, the regulated pressure level in the pressure regulation chamber 84, and other places, assures that the piston 52 returns to its position shown in FIG. 1 so that once again sealing off of the regions that are below the regulated pressure level from the higher pressure level in the can interior is attained. This assures that the spray valve 12 can always function at a virtually constant pressure level, for instance of 3 bar, while the pressure level in the can interior decreases continuously from what is initially 10 or 12 bar, for instance. As a result, an advantageous atomization of the aerosol as it is dispensed from the spray head (not shown) is attained. Since no axial face of the piston 52 is exposed to the pressure prevailing in the can interior, no disturbing force dependent on the degree of filling of the can arises, so that an especially high precision of regulation is attained without requiring an especially large outer circumference of the pressure regulating valve 14. The volumetric losses from the pressure regulating valve 14, to be provided in addition in comparison to aerosol cans with a propellant gas filling, are therefore minimized. The individual parts of the unit 10 shown may be interlocked, press-fitted, glued, or welded in a suitable manner known per se.

In FIG. 5, a further version of a unit 110 comprising a spray valve 12 and a pressure regulating valve 14 is shown, in which components embodied identically to the version described above are identified by the same reference numerals. In a distinction from the version described above, instead of a cup-shaped outer housing 98, an annular attachment 112 with an integrally formed neck 114 is attached to the inner housing 56, to which a riser tube 116 is secured. An embodiment like this may under some circumstances require even less structural volume than that shown in FIGS. 1 and 4.

In FIG. 6, an arrangement of a pressure regulating valve 200 is shown, with the aid of which an aerosol spray can without propellant gas and with overpressure filling can be retrofitted with a spray valve 202. The spray valve 202 is seated in a known manner in a valve plate 204; a housing 206 of the spray valve 202 is embodied with a neck 208 for the placement of a connecting tube or hose 210. Typically, a riser tube to be attached there extends as far as the lowermost point of the bottom of the aerosol spray can, but in the present case the tube serves only to connect the spray valve 202 to the pressure regulating valve 200. For that purpose, the pressure regulating valve 200 has an upper housing part 212, which is provided with a neck 214 for connection to the connecting tube 210, whose central through bore 216 communicates with the pressure regulation chamber 84. The overpressure filling valve 34 is also embodied in the upper housing part 212; only the through openings 40 are embodied as suitably lengthened as far as the middle through bore 216 of the housing part 212. Instead of a neck 214, the housing part may also be provided with a sleevelike insertion part, which can be placed directly onto the neck 208 of the spray valve 202. Otherwise, the overpressure filling valve 200 corresponds to the version shown in FIGS. 1 and 4 and also functions like them.

The version shown in FIG. 6 offers the advantage that the spray valves used until now in aerosol spray cans filled with propellant gas can continue to be used with their valve plates; only an adaptation to the higher pressure level may possibly be needed. As a result, existing production systems can economically continue to be used without conversion, and in a simple assembly operation the pressure regulating valve 200 can be simply connected upstream of the spray valve 202.

In FIG. 8, a further version of a pressure regulating valve 300 is shown, which in its function corresponds substantially to the overpressure valve 200 shown in FIG. 6, but in it a piston 352 is embodied in comparison to the version described above standing on its head, that is, with the pressure regulation chamber 384 at the bottom, oriented toward the inlet neck 302. The through opening 302 communicates via an axial bore 306 in a housing insert 308 with a transverse opening 354, through which the can contents can flow into the pressure regulation chamber 384 via a transverse opening 380 and middle bore 382, when the sealing point has been opened by the sealing element 366. Via a throttle bore 385, which can assure a further pressure reduction, and a connecting conduit 399 extending laterally between the housing insert 308 and the valve housing 398, the pressure regulation chamber 384 is in turn in communication with the outlet side 316, which leads to the downstream spray valve (not shown in FIG. 8). A compression spring 390, seated in a chamber 389 closed off in pressuretight fashion with the aid of a seal 386, in turn shifts the regulating piston 352, when the pressure in the regulation chamber 384 is below the regulated pressure, into the opened position shown in FIG. 8. A capability of supplying gas at overpressure, similarly to the versions described above, is also conceivable and can readily be realized by means of a suitably adapted housing shape.

FIG. 9 shows a longitudinal section through a further pressure regulating valve 400, which in its structure is quite similar to the version shown in FIGS. 1 and 7, and therefore the same reference numerals have been assigned to components of identical function. Once again, supplying gas at overpressure can be provided for in the upper region of the valve housing.

A first difference in the pressure regulating valve of FIG. 9 is that instead of an annular disk-like sealing element, an O-ring is used as the sealing element 466. This O-ring 466 is in turn clamped in place between the cup-shaped inner housing 56 and an upper housing part 412 (similarly to the embodiment of FIG. 6); the inner housing 56 and the upper housing part 412 each have a respective annular protrusion 401, 403, and these assure a linear sealing contact with the sealing element 466, which has proved more favorable, under many conditions of use, than a two-dimensional contact. An annular protrusion of this kind is also advantageous if an annular disk-like sealing element is used. In addition, in an O-ring-like sealing element 466, the deformations in the axial direction are less, and more-precise sealing off, with a view to the position of the piston, is possible.

The upper housing part 412 also has one or more radial through openings 454, which when the sealing point is open as shown in FIG. 9 enables an outflow of the can contents through the openings 80, 82 into the pressure regulation chamber 84 and onward through a throttle bore 45, which assures a further pressure reduction upon outflow, into the through bore 216 to the spray valve (not shown).

As soon as the pressure in the pressure regulation chamber 84 has again reached the switching level, the piston 452 is moved into the position shown in FIG. 10, in which the sealing point by cooperation of the sealing element 466 with a sealing flank 468 of the piston cooperates sealingly, so that the can contents can no longer flow through the bores 80, 82 into the pressure regulation chamber 84. In the version shown in FIG. 10, a wall 455 is also provided radially outside the sealing element 466 in the region of the radial transverse openings 454; this wall radially stabilizes the sealing element 466 in this region.

Also in the version 400 of the pressure regulating valve shown in FIGS. 9 and 10, a spacer sleeve 491 is provided in the chamber 89 that is closed in pressuretight fashion; with the aid of this sleeve, the prestressing of the restoring spring 90 can be regulated, or in other words, depending on the height at which the spacer sleeve 491 is located, the regulating characteristic of the pressure regulating valve 400 can also be varied.

The variants 300, 400 of a pressure regulating valve shown in FIGS. 8, 9 and 10 are suitable for an arrangement similar to FIG. 6, in which the pressure regulating valve 300 or 400 is connected with the aid of a hose or neck to precede a spray valve.

A special feature that is common to the versions of FIGS. 8, 9 and 10 is also that the sealing rings 86, 94 used to seal off the piston 452 from the housing parts 56, 412 are disposed in respective grooves 488 and 496 which are wider than the sealing rings 86, 94, so that these rings can roll upon an axial motion of the piston 452 instead of being moved only purely in a sliding manner. As a result, the friction losses upon piston motion can be reduced, which in turn favorable affect the precision of regulation. It is understood that this characteristic can also advantageously be employed in the other versions described.

Modifications of the pressure regulating valves shown are readily conceivable, in particular in view of the position of the sealing point and the embodiment of the piston; care must be taken to assure that no axial faces of the pressure regulating piston are acted upon by the elevated internal pressure of the can, which decreases with progressive evacuation of the can contents.

The invention claimed is:

1. A pressure regulating valve for use in an aerosol spray can having a spray valve, in which the pressure regulating valve is used to lower a pressure level prevailing in a compressed-gas-filled interior of the can to a regulation pressure level at which the spray valve is desired to operate, the pressure regulating valve comprising:

a housing having a pressure regulation chamber which in use communicates with the spray valve, a regulating piston which is guided for movement in said housing and which in use is kept in equilibrium between a regulated pressure acting on a pressure end of said piston located in said pressure regulation chamber and a restoring force, said piston also having a free end remote from the pressure end, a sealing point provided between said regulating piston and said housing which is closed when the regulating pressure in said pressure regulation chamber is above the regulation pressure level of the spray valve, and a sealing means which is used for sealing off said free end of said piston at all times a) from the pressure level prevailing in the can interior and b) from the regulated pressure in said pressure regulation chamber, so that in use the pressure acting on said free end of the piston is at all times independent of the pressure level prevailing in the can.

2. The pressure regulating valve of claim 1, characterized in that the sealing point is provided in a middle region of the regulating piston.

3. The pressure regulating valve of claim 2, characterized in that the pressure regulation chamber communicates with the sealing point via openings in the piston.

4. The pressure regulating valve of claim 2, characterized in that:

the housing is cylindrical, the piston includes a piston shaft which is sealed with the cylindrical housing on both sides of the sealing point, and a first seal, on one side of the sealing point, is provided as part of the sealing means on the free end of the piston.

5. The pressure regulating valve of claim 4, characterized in that the sealing of the piston shaft with the cylindrical housing is effected with O-rings, which are disposed in grooves.

6. The pressure regulating valve of claim 5, characterized in that the grooves are wider than the respective O-ring.

7. The pressure regulating valve of claim 6, characterized in that the width of the grooves is selected such that the O-ring, in an adjusting region of the piston, rolls essentially without friction on the bottom of the groove and the opposite sealing face of the outsides of the piston and insides of the cylinder.

8. The pressure regulating valve of claim 1, characterized in that the restoring force is built up by means of a restoring spring which is disposed in a closed chamber of the housing that is sealed off by the sealing means.

9. The pressure regulating valve of claim 8, characterized in that a spacer for adjusting the spring prestressing force is disposed in the closed chamber.

10. The pressure regulating valve of claim 1, characterized in that between the piston and the housing, at least in one direction of motion, an axial stop is provided for limiting the mobility of the piston.

11. The pressure regulating valve of claim 1, characterized in that the piston diameter, viewed from the sealing point, is embodied differently in the two axial directions.

12. The pressure regulating valve of claim 1, characterized in that the region of the sealing point, an annular disk-like sealing element or an O-ring like sealing element is provided, which is fixed on the piston or the housing and cooperates sealingly with a shoulder or a face on the housing or on the piston, if the pressure in the pressure regulation chamber exceeds the regulated pressure level.

13. The pressure regulating valve of claim 11, characterized in that the cylindrical housing has two parts with optionally different inside diameters adapted to the piston diameters, and between them the sealing element is fixed.

14. The pressure regulating valve of claim 13, characterized in that in the region of contact with the sealing element and at least one of the two parts that fix the sealing element, a narrow annular ridge or protrusion for attaining a linear sealing action is provided.

15. The pressure regulating valve of claim 11, characterized in that the O-ring- or annular disk-like sealing element protrudes radially inward into an annular groove provided in a middle region of the piston.

16. The pressure regulating valve of claim 1, characterized in that the housing includes an inner housing part, for receiving the free end of the piston, and a cuplike outer housing part surrounds the inner housing part, said outer hosuing part being used for forming a connection between the can interior and the sealing point.

17. The pressure regulating valve of claim 1, characterized in that a neck is integrally formed onto or attached to the housing for use in connecting the sealing point to the can interior.

18. The pressure regulating valve of claim 1, characterized in that it has a neck which is connected in use to a neck of a spray valve.

19. The pressure regulating valve of claim 1, characterized in that on an outlet side thereof leading in use to the spray valve, an overpressure valve is provided, said overpressure valve opening above a predetermined limit pressure for supplying gas as during manufacture of the can to the can interior.

20. The pressure regulating valve of claim 1, characterized in that a throttle restriction is provided between the pressure regulation chamber and where the spray valve will be connected in use.

21. The pressure regulating valve of claim 1, characterized in that the pressure regulation chamber is located in use on the side of the piston remote from the spray valve, and a connecting conduit that bypasses the piston laterally connects the pressure regulation chamber with the spray valve.

22. The pressure regulating valve of claim 1, characterized in that further includes a spray valve.

23. The pressure regulating valve of claim 2, characterized in that there is an annular groove at the middle region of the regulating piston.

* * * * *